US007007942B1

(12) United States Patent
Stearns et al.

(10) Patent No.: US 7,007,942 B1
(45) Date of Patent: Mar. 7, 2006

(54) PANEL HANDLING APPARATUS

(75) Inventors: Clyde Stearns, Ruston, LA (US); Wayne Parks, Dubach, LA (US)

(73) Assignee: WPS Industries, Inc., Ruston, LA (US)

( * ) Notice: Subject to any disclaimer, the term of this patent is extended or adjusted under 35 U.S.C. 154(b) by 198 days.

(21) Appl. No.: 10/397,016

(22) Filed: Mar. 25, 2003

(51) Int. Cl.
*B65H 5/08* (2006.01)

(52) U.S. Cl. ..... 271/11; 271/96; 271/108; 271/30.1

(58) Field of Classification Search ..... 271/11, 271/94, 95, 96, 108, 30.1; 414/796.7, 797, 414/797.2
See application file for complete search history.

(56) References Cited

U.S. PATENT DOCUMENTS

| | | | | |
|---|---|---|---|---|
| 3,633,903 A | | 1/1972 | Foster | 271/74 |
| 3,737,034 A | | 6/1973 | Icard | 209/84 |
| 3,830,489 A | * | 8/1974 | Adams | 271/9.12 |
| 3,993,301 A | | 11/1976 | Vits | 271/98 |
| 4,474,397 A | | 10/1984 | Hassan et al. | 294/64 |
| 4,627,606 A | | 12/1986 | Moore | 271/98 |
| 5,232,213 A | * | 8/1993 | Parsons et al. | 271/95 |
| 5,451,086 A | | 9/1995 | Pazzaglia | 294/64.1 |
| 6,443,442 B1 | * | 9/2002 | Willis et al. | 271/11 |

* cited by examiner

*Primary Examiner*—David H. Bollinger
(74) *Attorney, Agent, or Firm*—Jones, Walker, Waechter, Poitevent, Carrere & Denegre, L.L.P.

(57) ABSTRACT

An apparatus and method for lifting, separating and transporting a top panel from a stack of panels through the application sequential suction forces. The apparatus and method uses a vacuum conveying system wherein a sequence of suction forces is exerted from one or more suction apertures. A lift bed located beneath the vacuum conveying system, supports a stack of panels, and can be vertically elevated, causing a top panel from the stack of panels to move within sufficient distance of the vacuum conveying system to allow the sequence of suction forces to lift and separate the top panel. Once the top panel is engaged with the conveyor, the conveyor transports the top panel to a designated location.

19 Claims, 14 Drawing Sheets

PANEL HANDLING APPARATUS

FIELD OF THE INVENTION

The invention relates to apparatuses for lifting, separating and handling flat panels of material such as siding and other similar sheeted-materials. In particular, the invention relates to devices for separating and handling a top panel from a stack of panels by a sequence of suction forces.

BACKGROUND OF THE INVENTION

Within the siding industry, and other similar sheeted-material processing industries, the processing of panels occurs in different stages and at different locations within a production facility. Processing oftentimes includes sanding, priming and coating the panel in preparation for its end use. In order to enhance storage efficiency during processing, as well as ease of distributing, the panels are commonly stored in stacks.

Because panel processing occurs in various stages and in different locations, the siding industry, and other similar sheeted-material processing industries have developed techniques for separating individual panels from a stack of panels and transporting the individual panel to different processing locations within a processing facility. One technique for separating and transporting panels is by vacuum suction and conveyor belts. This technique utilizes the suction produced from a vacuum to lift the panel from the stack and to hold the panel against a conveyor belt. Once the panel engages the conveyor belt, the conveyor belt transports the panel to a different processing location within the processing facility.

A common problem associated with existing conventional vacuum conveyor systems is those systems' inability to overcome the cohesive forces between a top panel and those panels directly beneath. As a result, conventional vacuum conveyors oftentimes are unable to lift a top panel from a stack of panels due to the magnitude of these cohesive forces. Also, cohesive forces commonly cause conventional vacuum conveyors to mistakenly lift two or more panels at once. This occurs when two or more panels remain attached to the top panel being lifted. The inability to separate the top panel from other panels results in processing inefficiencies including wasted panels, jamming other processing machines, and wasted manpower in monitoring the separation of panels. Likewise, the stuck panels create dangers within the processing facility. Because the stuck sheet panels are only attached to the top panel by cohesive forces, the stuck sheet panels are subject to fall at any given moment. Due to the heavy weights generally associated with panels, a falling panel poses grave threats to both human life and to other existing equipment within a processing facility. Also, the added weight of stuck panels to the vacuum conveyor often exceeds that weight which the vacuum suction force can maintain. As a result, all stuck panels may overcome the suction force and fall.

Another common problem associated with conventional vacuum conveyors is their slow rate of processing panels. Generally, conventional vacuum conveyors are only able to process 6–7 panels per minute.

SUMMARY OF THE INVENTION

Given these deficiencies in the prior art, the present invention is related to a different device and method for separating, lifting and transporting sheet panels. The present invention utilizes the application of a sequence of vacuum suction forces to create a "peeling action" on a top panel of a stack of panels. This "peeling action" effectively overcomes the cohesive forces between adjacent panels within a stack. Also, lifting, separating and transporting panels by use of sequential suction forces is twice as fast as conventional vacuum conveyors. The present invention is capable of processing 15 panels per minute. This significantly reduces the amount of time needed to process a stack of panels.

The present invention includes a housing with a conveyor adjacent thereto, wherein the underside of the housing defines one or more suction apertures suitable for applying sequential suction forces. One or more vacuum sources are positioned above the housing, wherein the vacuum source is capable of applying a suction force across the conveyor and the panel surface. The housing may contain one or more separate intake chambers. In certain embodiments, the housing and conveyor are capable of canting about a pivot point. A lift bed, suitable for supporting a stack of panels, is positioned beneath the conveyor and has an elevator attached thereto. The elevator is capable of vertically raising and lowering a stack of panels to within a sufficient distance of the conveyor and housing to allow sequential suction forces to lift and separate a top panel from the stack of panels. A frame supports the housing and conveyor above the lift bed. Once the top panel is engaged with the conveyor, the conveyor is capable of transporting the top panel to a designated location.

Accordingly, it is an object of the invention to provide an apparatus and method for lifting, separating and transporting a top panel from a stack of panels by the application of a sequential suction forces.

For a better understanding of the invention as well as other objects and further features thereof, reference is made to the following drawings and descriptions.

BRIEF DESCRIPTION OF THE DRAWINGS

FIG. 2G is a schematic representation of the apparatus showing the deactivation of the front intake chamber once the top panel has been transported from the conveyor.

DETAILED WRITTEN DESCRIPTION OF THE PREFERRED EMBODIMENTS

The following is a detailed description of the preferred embodiment of the present invention. Although the hereinafter described embodiments are certain preferred embodiments of making and using the invention, it is understood that the invention is not limited to the specific embodiments described. It should be apparent that other embodiments not described herein may be made pursuant to the claimed invention.

Figure 1:
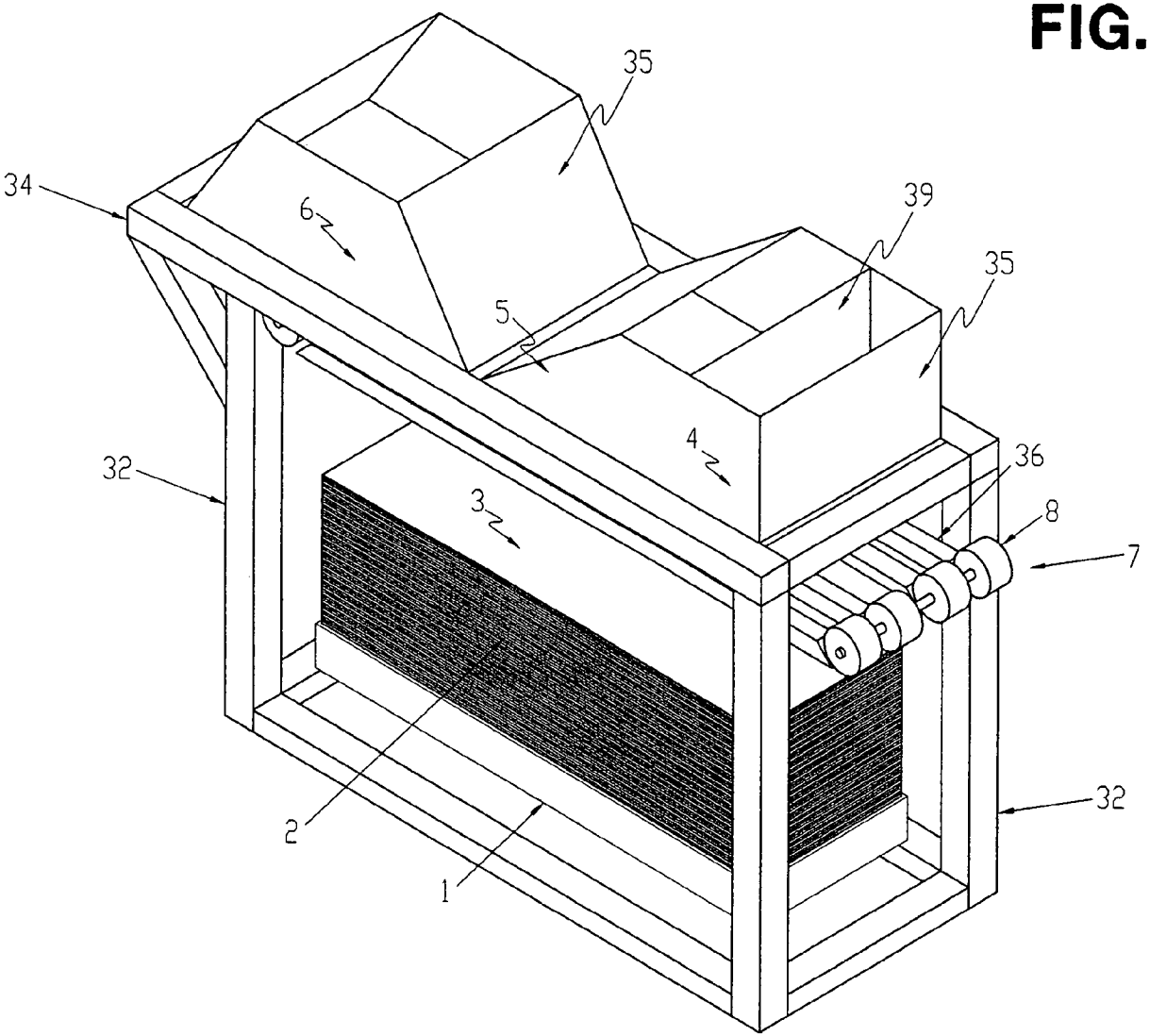
FIG. 1 is a isometric view, illustrating the apparatus according to the present invention, and looking from above toward the front thereof.

Referring to the drawings, the illustrated embodiment is an apparatus designed for lifting separating, and transporting a top panel from a stack of panels by the application of a sequence of suction forces along the length of a top panel. Although a panel is shown in FIG. 1 as having consistently flat, rectangular shape, a panel may also include any type of material having any combination of weight, dimension, and shape suitable for lifting and separating by application of sequential suction forces. For example, 4' wide×12' long×5/16" thick siding panels are commonly used in conjunction with the below described embodiment. The apparatus illustrated will typically handle panels weighing between ten pounds and one hundred fifty pounds. It should be obvious to those skilled in the art that alternate embodiments of the present invention may be designed for accommodating heavier or lighter weighted panels. However a panel does not include standard-sized or legal-sized sheets of paper, and therefore the claimed apparatus is not intended for handling the same.

Referring to FIG. 1, lift bed 1 is positioned at the lower portion of the apparatus and serves as both a receiving zone for a stack of panels and a support for vertically elevating and lowering a stack of panels.

Figure 3:
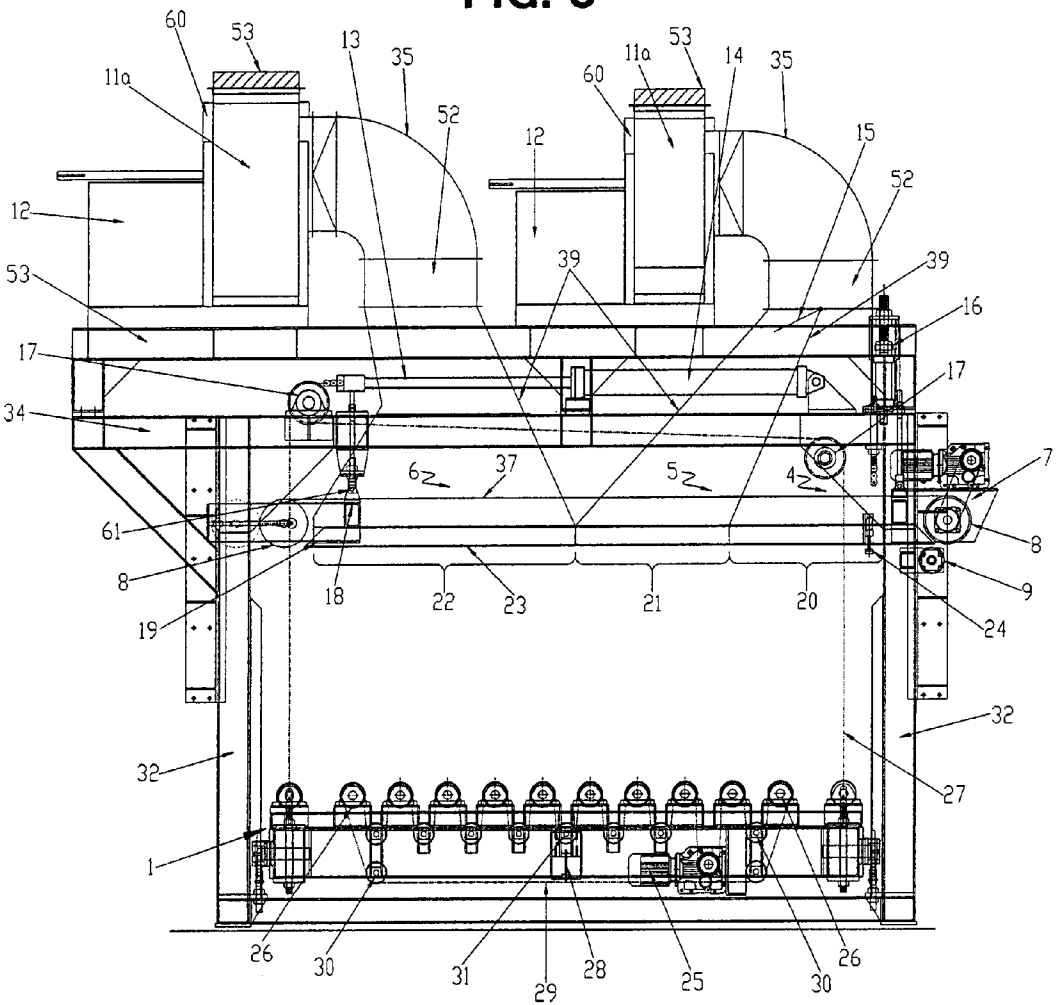
FIG. 3 is a side view of the apparatus.

Referring now to FIG. 3, the lift bed 1 is positioned between vertical frame members 32 and beneath conveyor 7. The lift bed 1 is comprised of a generally known roller conveyance system. The construction of the roller conveyance system does not form part of the present invention. However, by way of background, the roller conveyance system includes multiple grip rollers 26, spaced parallel to one another and extending transverse to the length of the lift bed 1. The grip rollers 26 form the flat, upper surface of the lift bed 1. A series of tension sprockets 30 are positioned beneath the grip rollers 26, and spaced along the length of lift bed 1. Tension sprockets 30 are generally known and have teeth around their perimeter for engaging the drive chain 29. The drive chain 29 operatively connects grip rollers 26 and tension sprockets 30 to drive motor 25 in a known configuration within the art, creating a clockwise or counterclockwise rotation of grip rollers 26 for receiving or transporting a stack of panels (not shown) onto or off lift bed 1. A center tension sprocket 31 is connected to a adjustable take-up idler 28. The adjustable take-up idler 28 is anchored to a lower portion of the lift bed 1 by a long, threaded bolt. To add tension to the drive chain 29, the take-up idler is lowered in a vertically downwardly direction, thereby lowering the center tension sprocket 31 connected thereto. Because the drive chain 29 engages the center tension sprocket 31, moving the center tension sprocket in a downwardly direction takes up the slack in the drive chain 29 and creates an increase in tension on the drive chain 29. It should be obvious to those skilled in the art that other known devices for adjusting the tension of drive chain 29 may be used in lieu of the adjustable take-up idler 28. Grip rollers 26 have an outer surface capable of supporting the bottom surface of a stack of panels, and capable of transporting or receiving a stack of panels. Although the illustrated embodiment shows a conventional roller conveyance system forming lift bed 1, it should be obvious to those skilled in the art that other conventional conveying systems could be used in lieu of the roller conveyance system, including belt conveying systems. Nor is it strictly necessary for lift bed 1 to be capable of conveying panels in a horizontal direction.

An elevator is connected to lift bed 1 for vertically raising and lowering lift bed 1. The elevator shown in the illustrated embodiment includes a z-chain mechanism, well known within the art for vertically raising and lowering supported structures. The z-chain mechanism is comprised of a chain 27 connecting opposite lower sides of a length-oriented lift bed 1 to an above mounted retractable piston rod 13. The chain 27 is supported by a multiple sprockets 17 mounted to middle fame member 34. When retractable piston rod 13 is extended in its outermost length position, chain 27 is also fully extended thereby causing lift bed 1 to vertically acquire its lowest position. As the retractable piston rod 13 retracts into the piston cylinder 14, the chain 27 is pulled with the retractable piston rod 13, causing the lift bed 1 to raise in a vertically upwardly direction. Although the illustrated embodiment shows a z-chain mechanism for vertically raising and lowering lift bed 1, it should be obvious to those skilled in the art that other elevating mechanisms known within the art could also be used. For example, an elevator may also include hydraulic lifts, screw lifts, scissor lifts and any other means for vertically elevating and lowering a lift bed. It should also be an obvious alternative embodiment to those skilled in the art that the conveyor 7 and housing 35 could be lowered to the top panel 3 instead of raising the lift bed 1 and such a configuration is intended to be within the scope of the present invention. Essential to the operation of the apparatus, the stack panels must be within sufficient distance to the suction force to permit the suction force to have a lifting effect upon a top panel positioned on the stack of panels. As mentioned above, the sufficient distance between the conveyor 7 and a top panel can be accomplished in numerous ways. First, as shown in the illustrated embodiment, an elevator can be connected to the lift bed 1, causing the lift bed 1 to vertically raise and lower relative to the conveyor 7. Second, although not shown in the figures, the conveyor 7 and the connected housing 35 can be lowered or raised relative to the lift bed. Third, both the conveyor 7 and the lift bed 1 can both vertically move relative to each other. Fourth, the conveyor 7 and housing 35 can be positioned sufficiently close to the lift bed 1 as to not require movement of either. However, under the fourth option, the suction force would need to gradually increase to compensate for the increasing distance between the uppermost panel and the conveyor as the stack of panels is reduced in height due to unstacking. Fifth, the lift bed 1 could be canted at an angle to position one end of a stack of panels to within sufficient distance of the conveyor 7. And Sixth, the conveyor 7 could be canted at an angle to position one end of the conveyor 7 and housing 35 to within sufficient distance of a stack of panels to permit the suction force to have a lifting effect upon a top panel positioned on the stack of panels.

Figure 4:
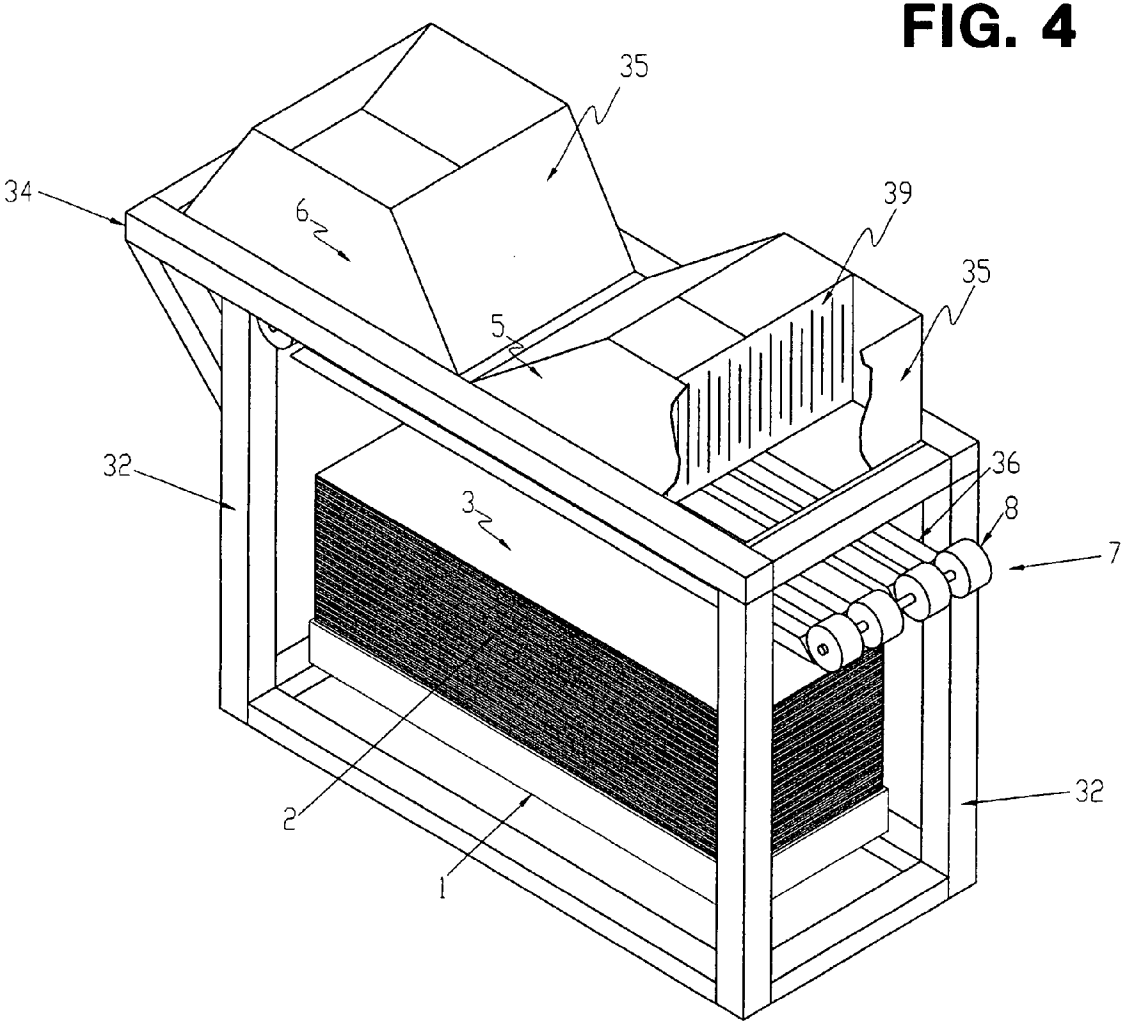
FIG. 4 is a isometric view, illustrating the apparatus according to the present invention, and looking from above toward the front thereof and having a cut-out section of the housing.

Referring now to FIG. 4, a conveyor 7 is longitudinally positioned above lift bed 1 and operatively connects to the underside of housing 35, as explained in more detail below. Conveyor 7 is comprised of four parallel spaced belt runners 36 longitudinally oriented along a horizontal plane. A belt roller 8 is positioned at opposite ends of each belt runner 36, thereby creating four belt rollers 8 on each length end of the longitudinally oriented conveyor 7.

Figure 5A:
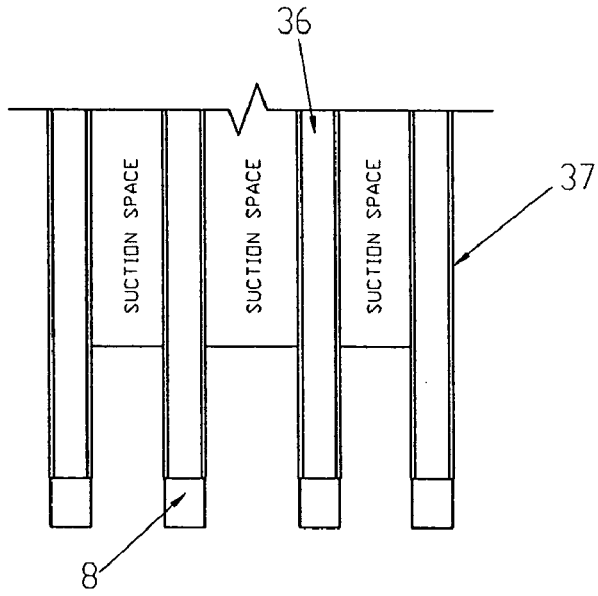
FIG. 5A is a top view of the conveyor, excluding the upper portion of the conveyor belt.
Figure 5B:
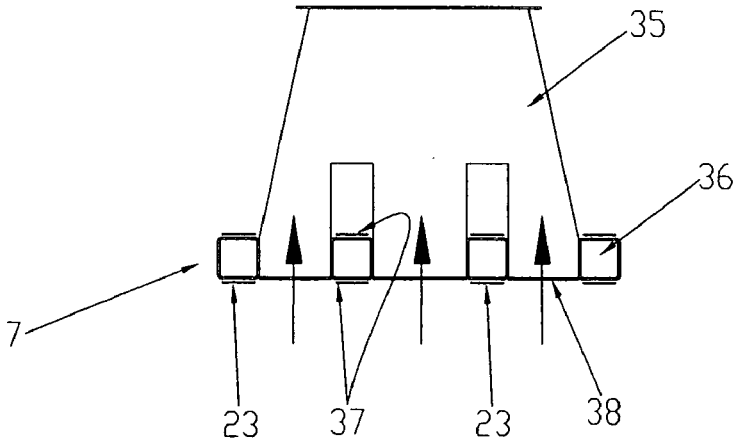
FIG. 5B is a front sectional view of the conveyor and housing.

Referring now to FIGS. 5A and 5B, FIG. 5A illustrates a top view of the conveyor 7, and FIG. 5B illustrates a front sectional view of one of the longitudinal ends of conveyor 7. The conveyor 7 further comprises four endless belts 37, each belt encircling a single belt runner 36 along the belt runner's 36 length, and supported by belt rollers 8 on both ends thereto. Belt runners 36 in the illustrated embodiment shown are lengths of metal tubing, having a rectangular shape. However, a belt runner could be any material and shape capable of supporting belts 37. A lower elongate section 23 of each belt runs beneath the belt runner 36 and forms the engagement surface for engaging a top panel (not shown).

As illustrated by upwardly pointed arrows in FIG. 5B, the spaces 38 between each parallel belt runner 36 are areas of suction passage therethrough. Each belt runner 36 blocks the lower elongate section 23 of each respective belt 37 from the suction force, thereby preventing the lower elongate section 23 from being sucked upward by the suction force. The illustrated embodiment shows four belts 37, however, any number of belts spaced at varying distances could be used to define suction passages. Although spaced belts define suction passages in the illustrated embodiment, the present invention encompasses other well known vacuum belt arrangements used to create suction passages, including perforated conveyor belts. Also, it should be obvious that other generally known conveying methods could be used in lieu of conveyor belts, including roller conveyors as described in connection with the above described lift bed 1.

Referring now to FIG. 3, a housing 35 is positioned above and adjacent to the conveyor 7 and contains intake chambers 4, 5, 6 which are separated by walls 39. The underside of housing 35 defines suction apertures 20, 21, 22 and interfaces with conveyor 7 as described below. Intake chambers 4, 5, 6 define separate intake passages for the intake of air from suction apertures 20, 21, 22 to the vacuum sources 11*a*, 11*b*. Although the housing 35 in the illustrated embodiment shows two separate structures containing intake chambers 4, 5, 6, a housing includes any single structure or combination of separate structures defining at least one suction aperture, wherein the suction aperture or apertures are capable of exerting a sequence of suction forces when used in combination. It should be obvious to those skilled in the art that a housing may take any shape or dimension suitable for allowing the passage of air from suction apertures to a vacuum source. It should further be obvious to those skilled in the art that a suction aperture can be any orifice or combination of orifices of any shape and size which permits the intake of air.

FIG. 5B details the interface between the lower portion of housing 35 and conveyor 7. As illustrated, the lower portion of the housing 35 interlocks between belt runners 36 to minimize air intake from all direction except through spaces 38 between belt runners 36, thus maximizing the suction drawn through spaces 38. That portion of the housing 35 separating intake chambers 4, 5, 6, is also formed to minimize air intake from all direction except between belt runners 36. The suction apertures 20, 21, 22, as seen in FIG. 3, are formed above the lower elongate section 23 of the belt 37. The suction force exerted from the suction apertures 20, 21, 22 passes through spaces 38 between the belt runners 36 and causes a top panel (not shown) to engage the lower elongate section 23 of the belt 37.

Referring now to FIG. 3, two vacuum sources 11*a*, 11*b* are mounted to upper frame member 33, and operatively connect to the housing 35 and intake chambers 4, 5, 6 to create substantial airtight intake passages between suction apertures 20, 21, 22 and vacuum sources 11*a*, 11*b*. Vacuum sources 11*a*, 11*b* evacuate the air from intake chambers 4, 5, 6 to produce a suction force at suction apertures 20, 21, 22. Although the illustrated embodiment shows two vacuum sources 11*a*, 11*b*, a single vacuum source or more than two vacuum sources can be used to create a sequence of suction forces. The illustrated embodiment utilizes fans as vacuum sources 11*a*, 11*b* to evacuate air. In the embodiment shown, each fan is a forty horsepower, conventional centrifugal type fan. Also, each fan has a primary rating of five thousand cubic feet per minute of air, and a secondary vacuum capability of drawing twelve inches of water. A centrifugal fan, as used in the illustrated embodiment, positioned with its outflow facing north and its inflow facing south, also has a breather 60 on its sides. The inflow is operatively connected to the housing 35 and intake chambers 4, 5, 6. The air entering the inflow is what creates a suction force at suction apertures 20, 21, 22. It should, however, be obvious to those skilled in the art that vacuum sources 11*a*, 11*b* may also include any other well known means within the art for creating a suction force. Motors 12 supply power source for operation of vacuum sources 11*a*, 11*b*.

Continuing to refer to FIG. 3, dampening shutters 53 are connected to each breather 60 located on the side of vacuum sources 11*a*, 11*b*. As used in the illustrated embodiment, dampening shutters 53 are well known to those skilled in the art. The dampening shutters 53 open and close like window blinds for allowing or blocking the intake of air through the breather 60. Blocking the intake of air entering from breather 60 starves the vacuum sources 11*a*, 11*b* of air circulation needed for the fan blades to rotate as discussed above. Although dampening shutters 53 are used in the illustrated embodiment, dampening shutters 53 may include any well known device within the art for reducing air intake. Also, it should be obvious to those skilled in the art that dampening shutters 53 could be connected to the inflow or outflow of vacuum sources 11*a*, 11*b* to accomplish a reduction in air intake. Dampening shutters 53 regulate the magnitude of suction force produced at suction apertures 20, 21, 22, and may be used in combination to create a sequence of suction forces exerted from suction apertures 20, 21, 22 or to create a gradient in the magnitude of suction force exerted across suction apertures 20, 21, 22.

As discussed above, intake chambers 4, 5, 6 operatively connect suction apertures 20, 21, 22 to vacuum source 11*a*, 11*b* defining passages for the flow of air between vacuum source 11*a*, 11*b* and suction apertures 20, 21, 22. The illustrated embodiment is one of many ways of configuring intake chambers. Intake chambers 4, 5, 6 function as air ducts for the passage of air and may be constructed of varying dimensions and configurations so long as the passage of air between the vacuum source and suction aperture is maintained. It should be obvious to those skilled in the art that altering the dimensions of the of intake chambers and/or suction apertures while maintaining consistent air intake from a vacuum source may produce stronger or weaker suction forces exerted at the suction apertures.

Intake valve 15 is connected to the inner wall 39 shared by intake chambers 4, 5 and functions to allow or block the air flow between suction aperture 21 and vacuum source 11*b*. Intake valve 15 may be adjusted to opened, closed or any position there between. Although the illustrated embodiment utilizes a well known butterfly valve as intake valve 15, any conventional valve suitable for blocking air flow may be used.

Referring particularly to the illustrated embodiment in FIG. 3, when intake valve 15 is closed and vacuum source 11*b* is operating, a suction force is only exerted from suction aperture 20. Opening intake valve 15 while vacuum source 11*b* is still operating causes an additional suction force to be exerted from suction aperture 21, thereby creating a sequence of suction forces, first from suction aperture 20 and second from suction aperture 21. Turning on vacuum source 11*a* after opening intake valve 15 produces a third sequential suction force exerted from suction aperture 22. It should be obvious to those skilled in the art that intake valves, vacuum sources and intake chambers, can be combined, configured, and operated in any number of ways to produce a variety of sequential suction forces.

Figure 9:
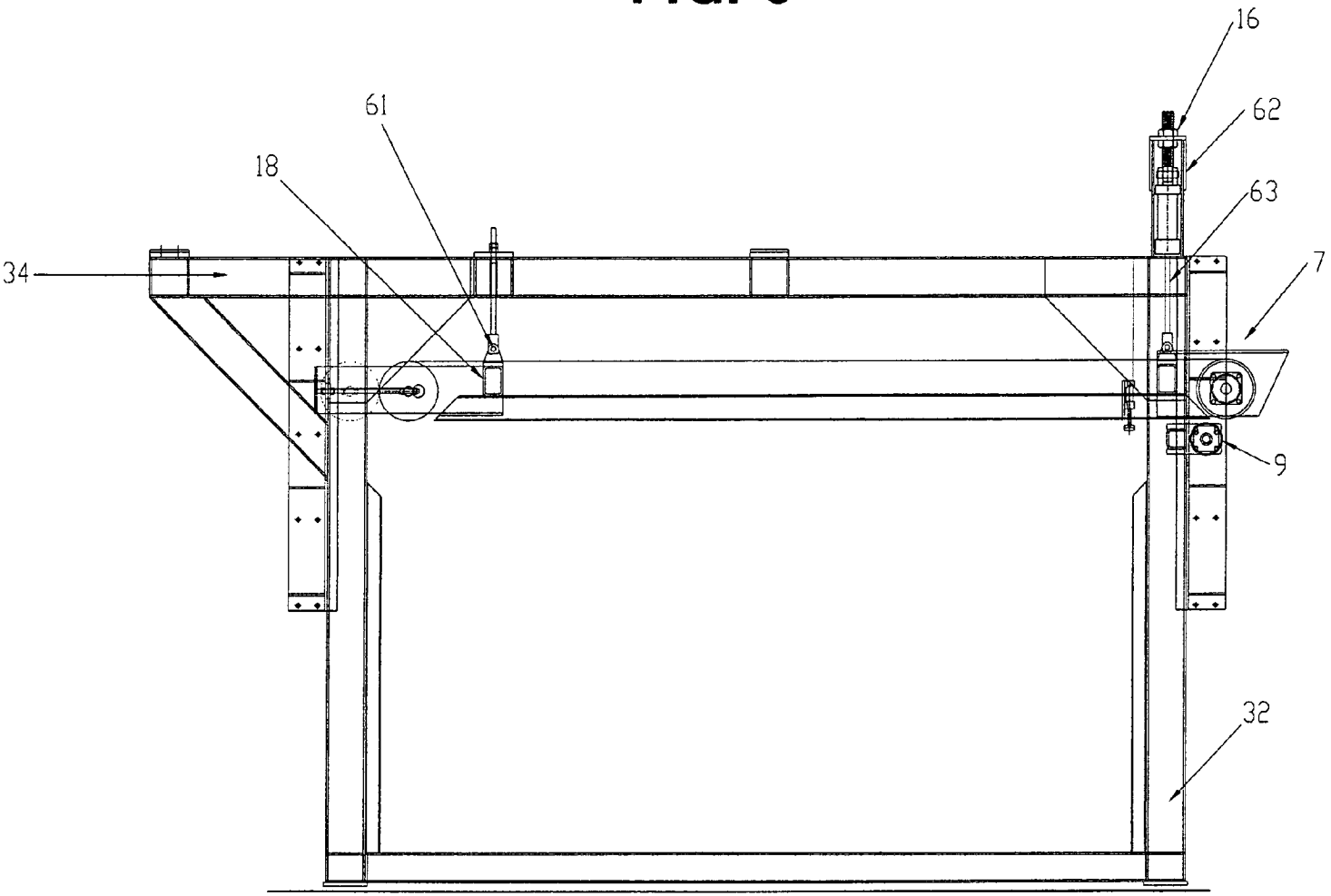
FIG. 9 is a side view of the apparatus.

The housing 35 and conveyor 7 are capable of being canted at various angles. Referring now to FIG. 9, canting device 16 and pivot 18 enable the housing 35 and conveyor 7 to be canted. While only one canting device 16 and one pivot 18 are seen in the side view of FIG. 9, it will be understood that another canting device 16 and pivot 18 are positioned on the other side of the apparatus. The two canting devices 16 are connected to upper frame member 33 (see FIG. 3) and middle frame member 34 for canting the leading ends of longitudinally oriented housing 35 and conveyor 7 about the two pivots 18. The two pivots 18 are connected to middle frame member 34 and include a point of rotation 61. In FIG. 9, each canting device 16 includes a hydraulic cylinder 62 capable of vertically extending and retracting. One end of hydraulic cylinder 62 is connected to upper frame 33 (see FIG. 3) and the piston 63 in cylinder 62 is connected to conveyor 7. The housing 35 and conveyor 7 seen in FIG. 3 are suspended from pivots 18 at the trailing end of the apparatus, and suspended from canting devices 16 at the leading end of the apparatus. Because the housing 35 and conveyor 7 are not rigidly fixed to middle fame 34, the housing 35 and conveyor 7 are able to move relative to the frame 34. The extension and retraction of piston 63 out of and into cylinder 62 acts to vertically lower and raise the leading end of the conveyor 7 (and thus housing 35), while the trailing end of conveyor 7 pivots about the rotation point 61 of the pivot 18.

Expansion joints 52 (see FIG. 3) connect the upper portion of housing 35 to the lower portion of housing 35. The upper portion of housing 35 is operatively connected to vacuum sources 11*a*, 11*b*. As stated above, vacuum sources 11*a*, 11*b* are mounted to upper frame member 33. Because the upper portion of the housing 35 is connected to rigidly mounted vacuum sources 11*a*, 11*b*, the expansion joints 52 permit the lower portion of the housing 35 to cant at various angles independently of the upper portion of housing 35. The expansion joints 52 are composed of flexible rubber. However, it should be obvious to those skilled in the art that other expanding joints could be used, including accordion-style joints.

The angle at which the conveyor 7 is canted during operation of the apparatus depends upon the physical properties of the panel being lifted. For example, the conveyor 7 is positioned horizontal (zero canted angle) for handling panels that are easily separated. However, panels having stronger cohesive properties may require the conveyor 7 to be canted at more steep angles in order to separate a top panel from its adjacent panel. In the illustrated embodiment, the maximum angle of cant for the conveyor 7 is a two inch slope across a twelve foot conveyor 7. However, a one inch slope across a twelve foot conveyor 7 is generally sufficient for overcoming the cohesive forces between most panels. It should be obvious to those skilled in the art that alternative embodiments could be allow for steeper angles of canting the conveyor 7. As an alternative to hydraulic cylinder 62, other generally known canting devices could be utilized in the present invention to accomplish the canting of the conveyor 7.

Viewing FIG. 3, a pinch roller 9 rotably connects to vertical frame member 32 and defines a receiving space between pinch roller 9 and belt roller 8 for the receipt of a top panel. Pinch roller 9 has a frictional surface suitable for gripping the lower surface of a top panel. The pinch roller 9 rotates in an opposite direction to the directional rotation of belt rollers 8, creating an additional pull force on the received top panel.

Multiple parallel spaced plungers 24 (only one shown in FIG. 3) are retractably mounted to the lower leading end of housing 35. In the illustrated embodiment, the plungers 24 are air pistons within cylinders that use the force of air to move the plungers. Occasionally, a top panel fails to separate from an underneath panel or panels when lifted from a stack of panels. When this occurs, two or more panels may become engaged with the conveyor 7 through suction force. The plungers 24 function to separate the top panel from other panels stuck thereto by extending vertically downward from the plungers' 24 retracted position thereby exerting a downward push onto the upper surface of a top panel. The downward push causes the top panel and panels stuck thereto, to flex. The flexing of the panels reduces the cohesive forces between the panels and causes those panels stuck to the top panel to separate from the top panel, leaving only the top panel engaged to conveyor 7. Although the illustrated embodiment utilizes air cylinders and pistons as plungers 24, it should be obvious that plungers 24 include any form of downward force capable of separating two or more stuck panels.

Figure 8:
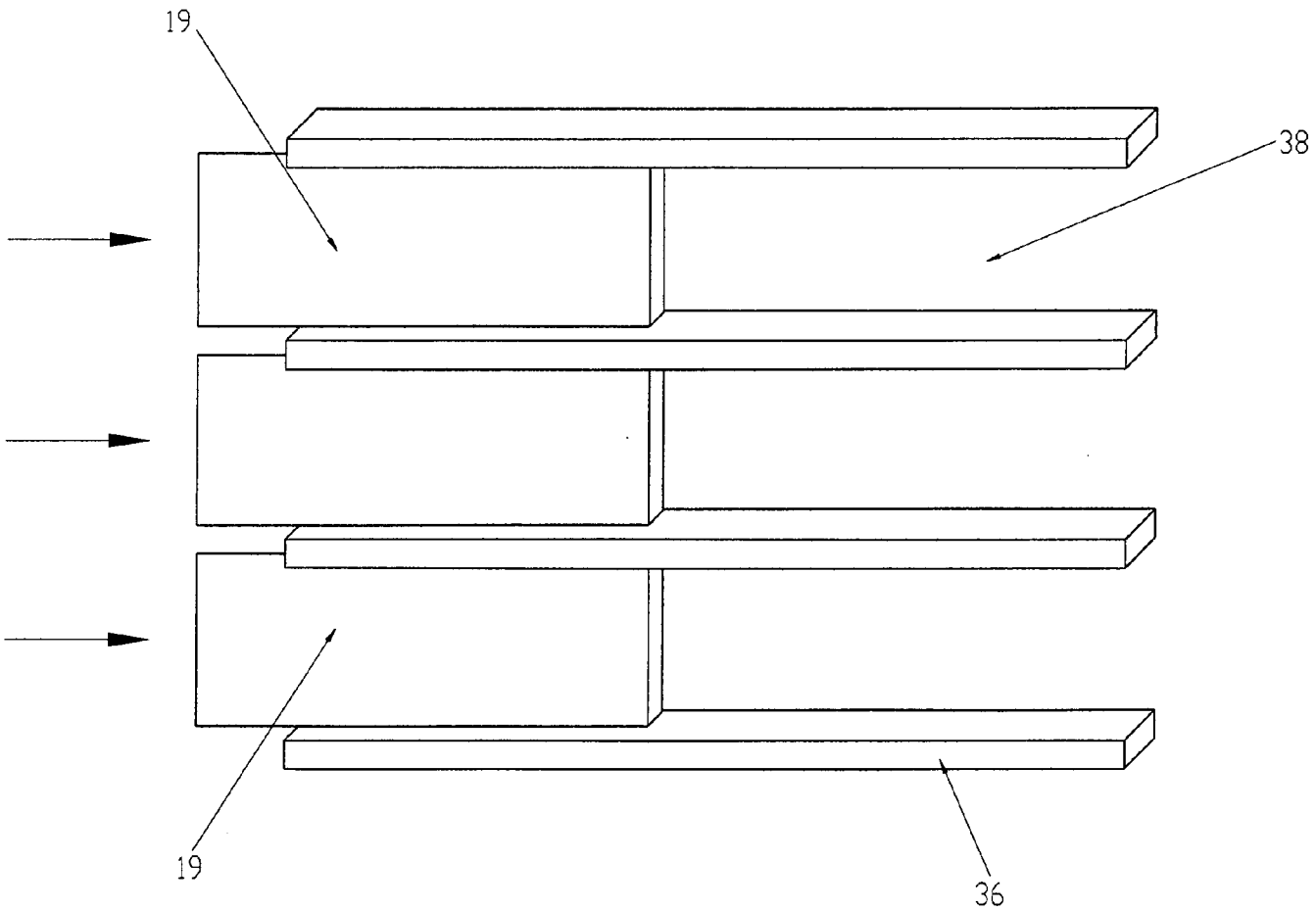
FIG. 8 is an underneath prospective view of one of the length ends of the conveying, showing the interface between belt runners and multiple slide gates.

Referring now to FIG. 8, multiple slide gates 19 are slidably mounted between those belt runners 36 positioned at one of the length ends of conveyor 7. The slide gates 19 function to block the suction passage 38, and slide along the length of the conveyor 7. The slide gates 19 effectively reduce the total length area of suction by partially blocking the intake of air into suction aperture 22. If a panel is as long as the combined length of suction apertures 20, 21, 22, the slide gate 19 is fully opened (i.e., slid to the rear) to allow intake of air from all suction apertures 20, 21, 22. However, if a panel is shorter than the combined length of suction apertures 20, 21, 22, the slide gate 19 could be used to shorten the length of suction area along the length of the conveyor 7 by blocking the intake of air from the trailing end of suction aperture 22. For example, the illustrated embodiment is designed to lift a 4'×12' panel with the slide gate open. The illustrated embodiment may also lift a 4'×8' panel by using the slide gate to block the trailing four feet of suction aperture 22 along the length of the conveyor, in effect, reducing the original twelve foot length of suction area to an eight foot length of suction area.

Figure 2A:
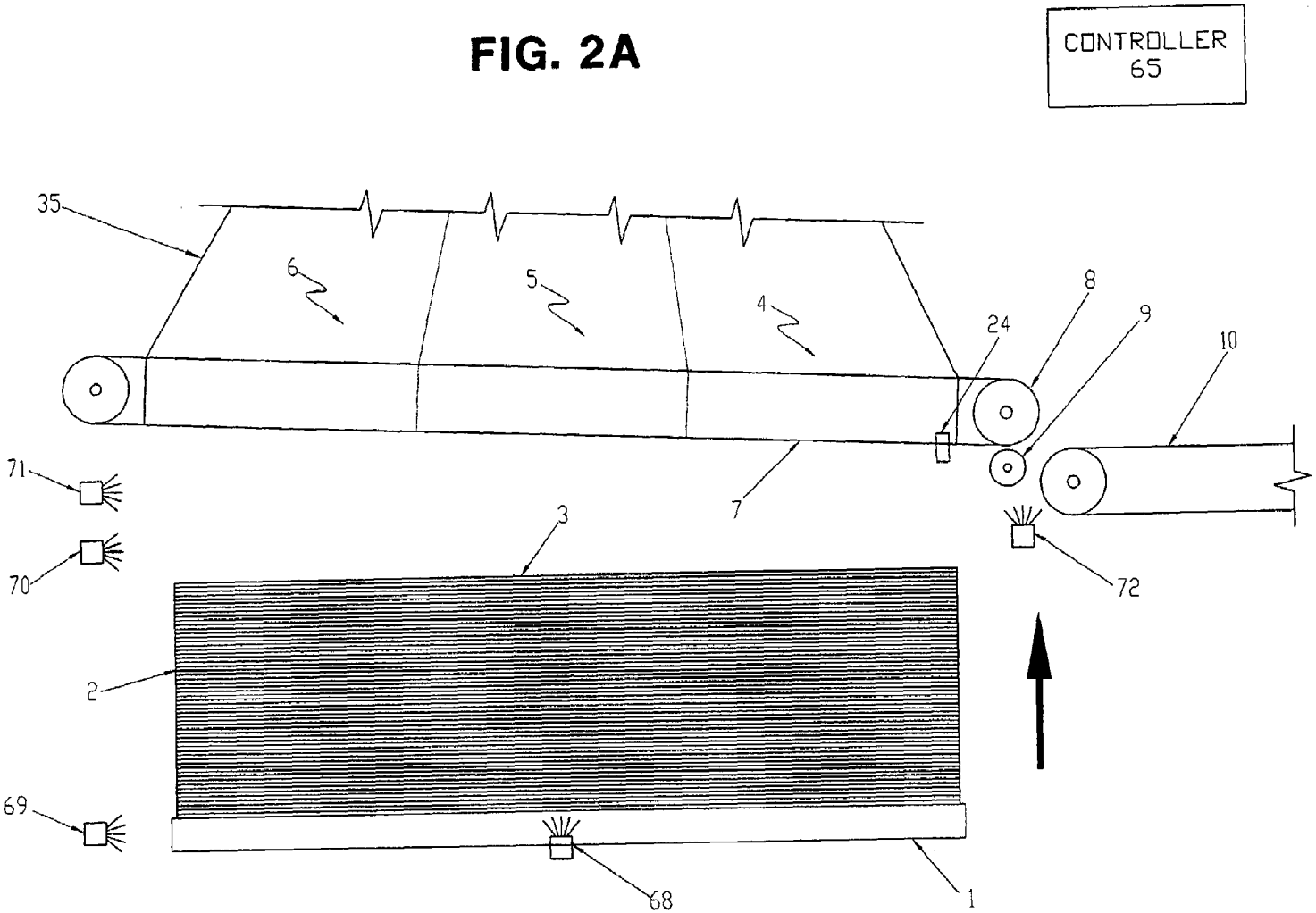
FIG. 2A is a schematic representation of the apparatus showing the lifting bed vertically moving the stack of panels to a canted conveyor and housing.
Figure 2B:
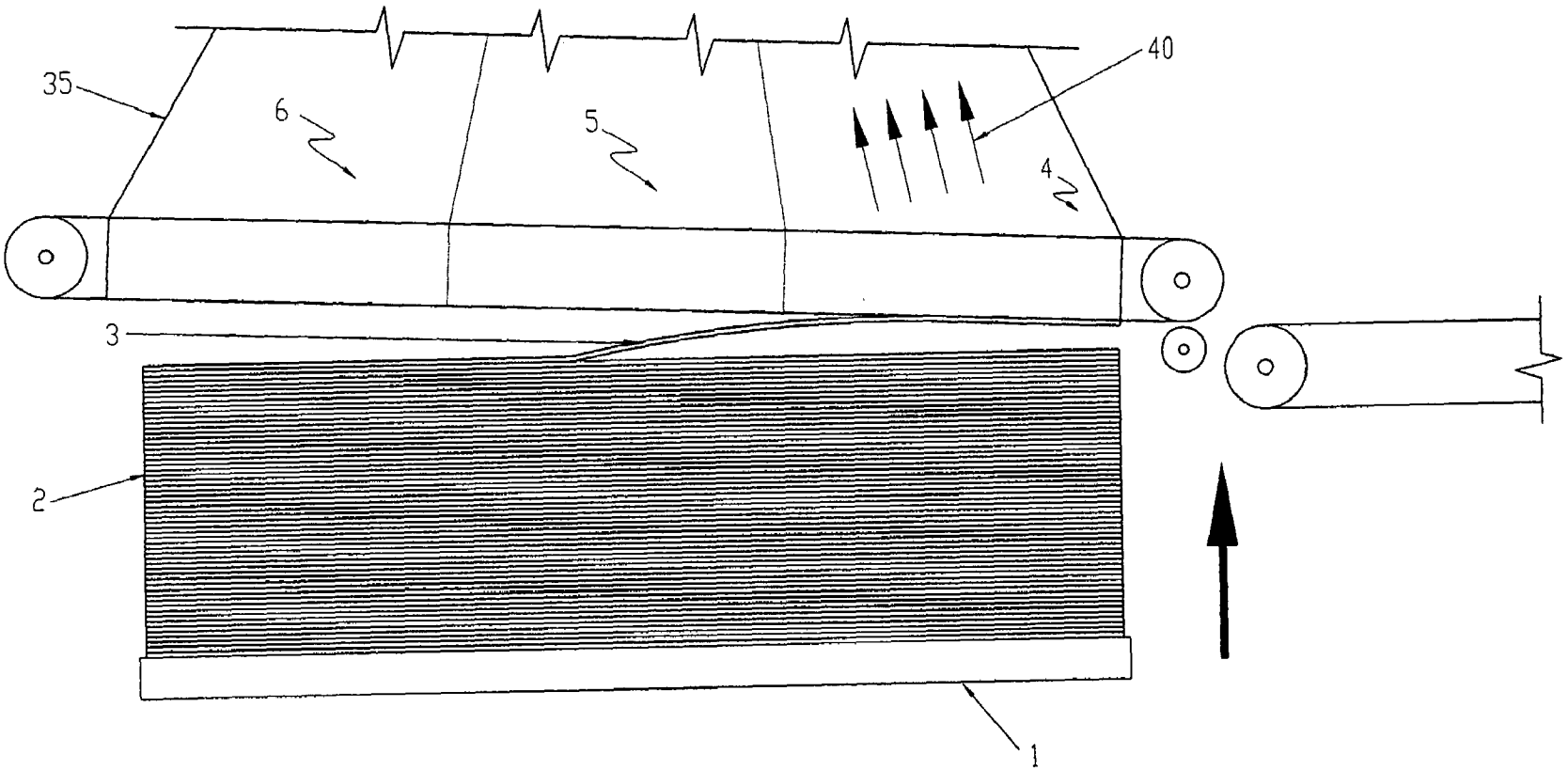
FIG. 2B is a schematic representation of the apparatus showing the front intake chamber exerting a suction force on the upper surface of the top panel, causing the front section of the panel to engage the conveyor by suction force.

FIGS. 2A–2F illustrate the operation of the apparatus. Referring particularly to FIG. 2A, the lift bed 1 is positioned below conveyor 7 and housing 35. A stack of panels 2 is positioned on top of the lift bed 1. The conveyor 7 is canted along its longitudinal axis about a pivot point (illustrated as 18 on FIG. 3), causing the leading end of conveyor 7 to be lower relative to the trailing end of conveyor 7. Once the stack of panels 2 is positioned on the lift bed 1, the elevator vertically raises the lift bed 1, as shown by the upwardly pointed arrow, causing the top panel 3 to move close enough to conveyor 7 so as to permit a suction force exerted from a suction aperture to lift the front section of the top panel 3 into engagement with the conveyor 7, as seen in FIG. 2B. The distance between the top panel 3 and the conveyor 7 that is sufficient to permit lifting the top panel 3 will vary depending on the magnitude of the suction force applied to the top panel 3 as well as the weight, dimensions, surface friction, cohesive properties and density of the top panel 3.

FIG. 2B illustrates the activation of vacuum source (not shown) thereby causing a first suction force to be exerted from intake chamber 4, as depicted by the four upwardly pointing arrows. The first suction force 40 is applied to the upper front surface of the top panel 3 causing the front section of the top panel 3 to lift and engage the conveyor 7. At this stage the top panel 3, is beginning to peel away from the stack of panels 2 as illustrated. This peeling motion effectively overcomes those cohesive forces that cause panels to stick together.

Figure 2C:
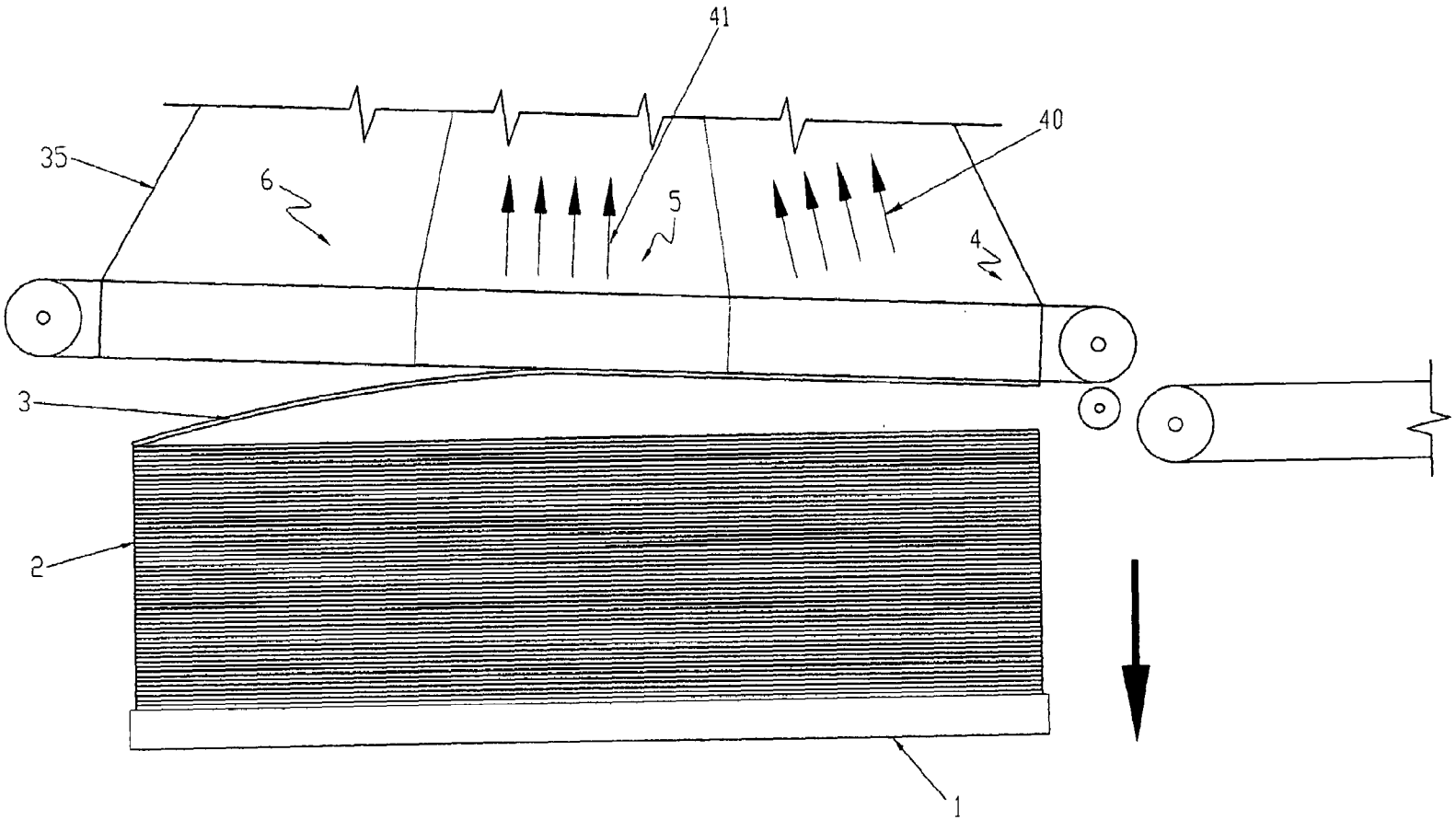
FIG. 2C is a schematic representation of the apparatus showing the middle intake chamber exerting a suction force on the upper surface of the top panel, causing the middle section of the panel to engage the conveyor by suction force and also showing the lowering of the lift bed to reduce cohesive forces between the top panel and the panel beneath and adjacent to the top panel.

FIG. 2C illustrates the application of a second suction force 41 exerted from intake chamber 5 upon a middle upper surface of top panel 3. The application of the second suction force 41 causes the middle section of the top panel 3 to lift and engage the conveyor 7, thereby further separating the top panel 3 from the adjacent panel beneath. At a time close in proximity to the application of the second suction force 41, the elevator (not shown) vertically lowers the lift bed 1 causing further separation between the top panel 3 and an adjacent panel beneath. At this stage, both a first suction force 40 and a second suction force 41 is being applied to the to panel 3.

Figure 2D:
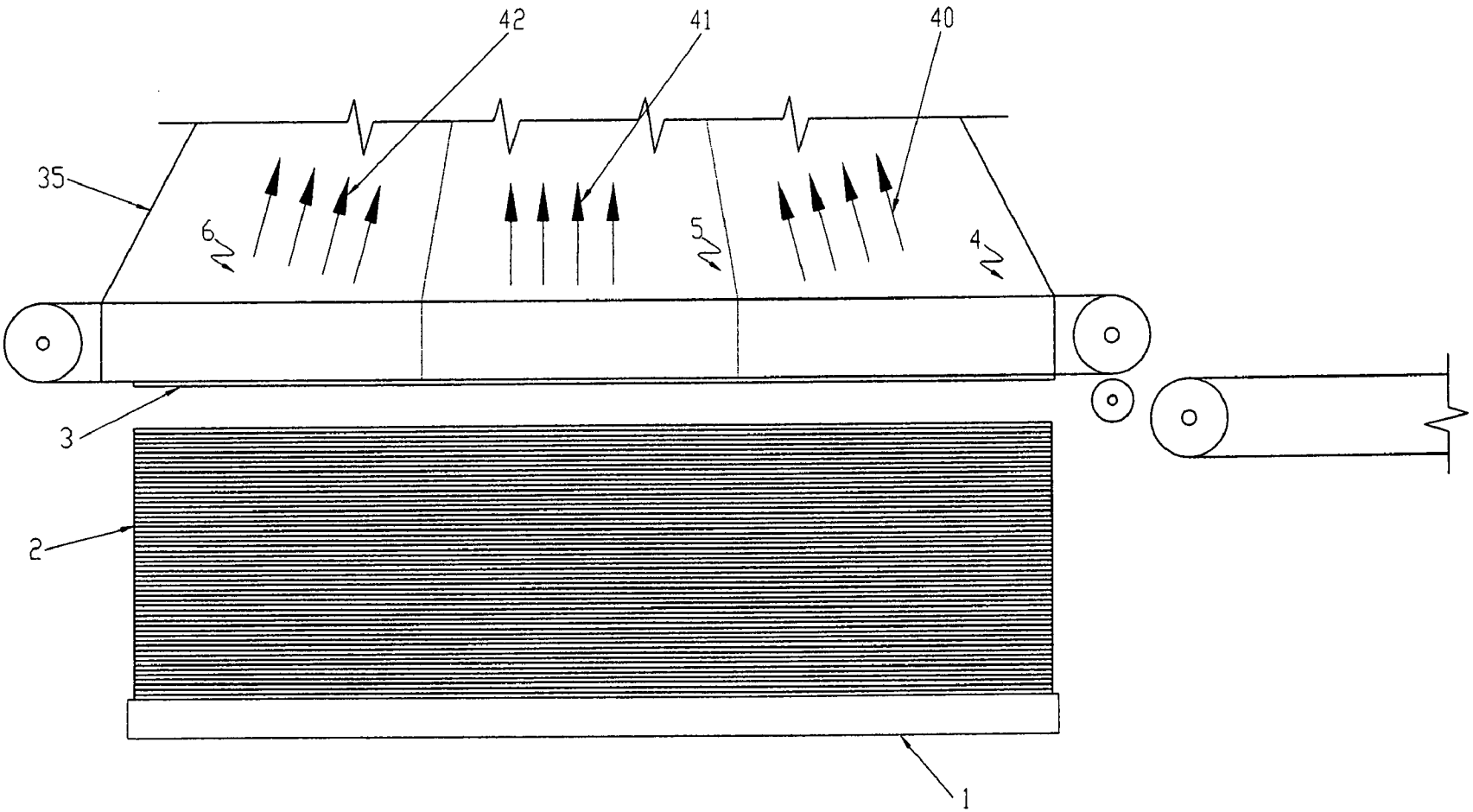
FIG. 2D is a schematic representation of the apparatus showing the back intake chamber exerting a suction force on the upper surface of the top panel, causing the back section of the top panel to engage the conveyor belt by suction force.

Next, FIG. 2D illustrates the application of a third suction force 42 to the upper back surface of the top panel, causing the back section of the top panel 3 to lift from the stack of panels 2 and engage the conveyor 7. At this stage, all three suction forces 40, 41, 42 are being applied to the to panel 3, keeping the top panel 3 engaged to conveyor 7.

Figure 2E:
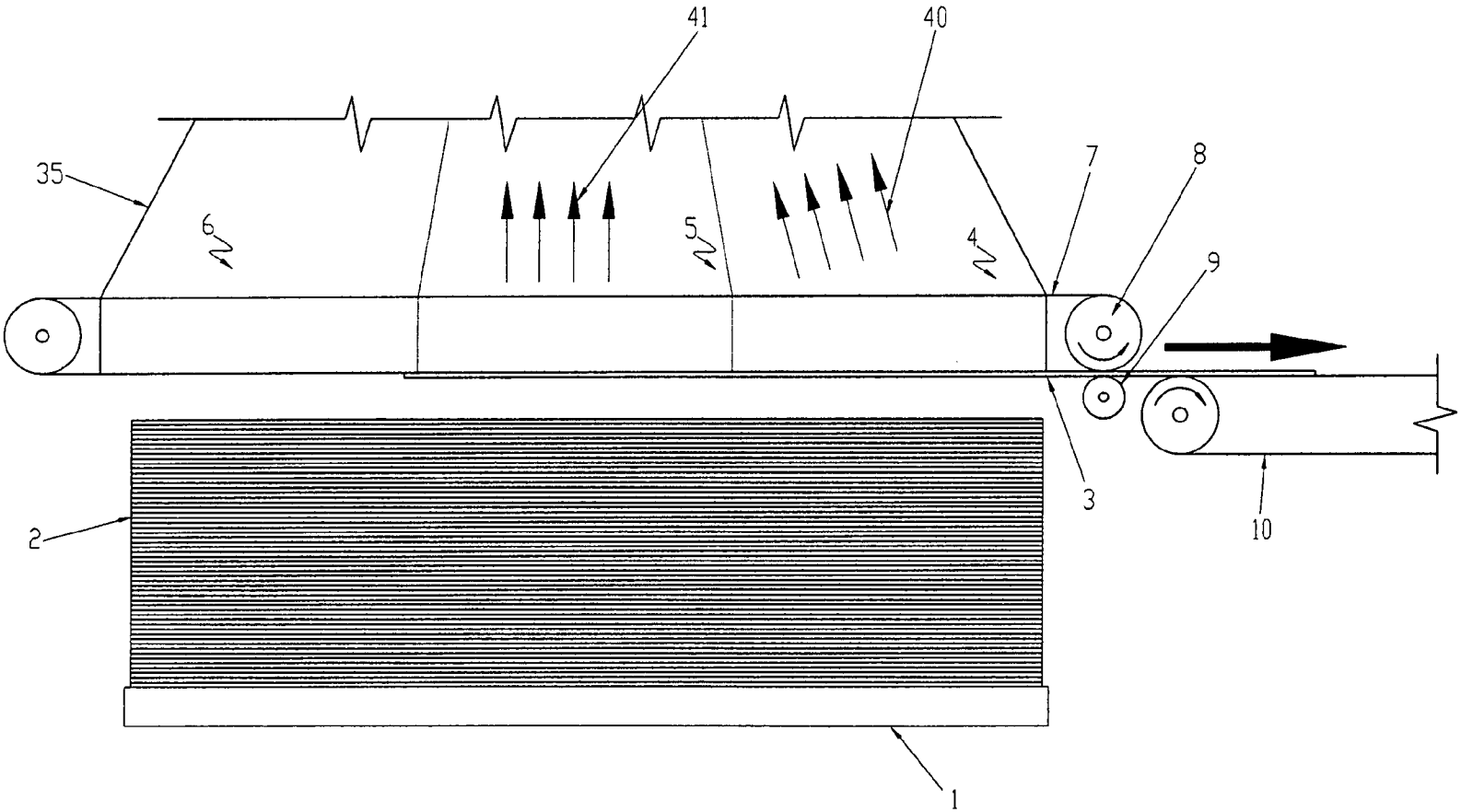
FIG. 2E is a schematic representation of the apparatus showing the transport of the top panel longitudinally by the conveyor and the deactivation of the suction force produced by the back intake chamber.
Figure 2F:
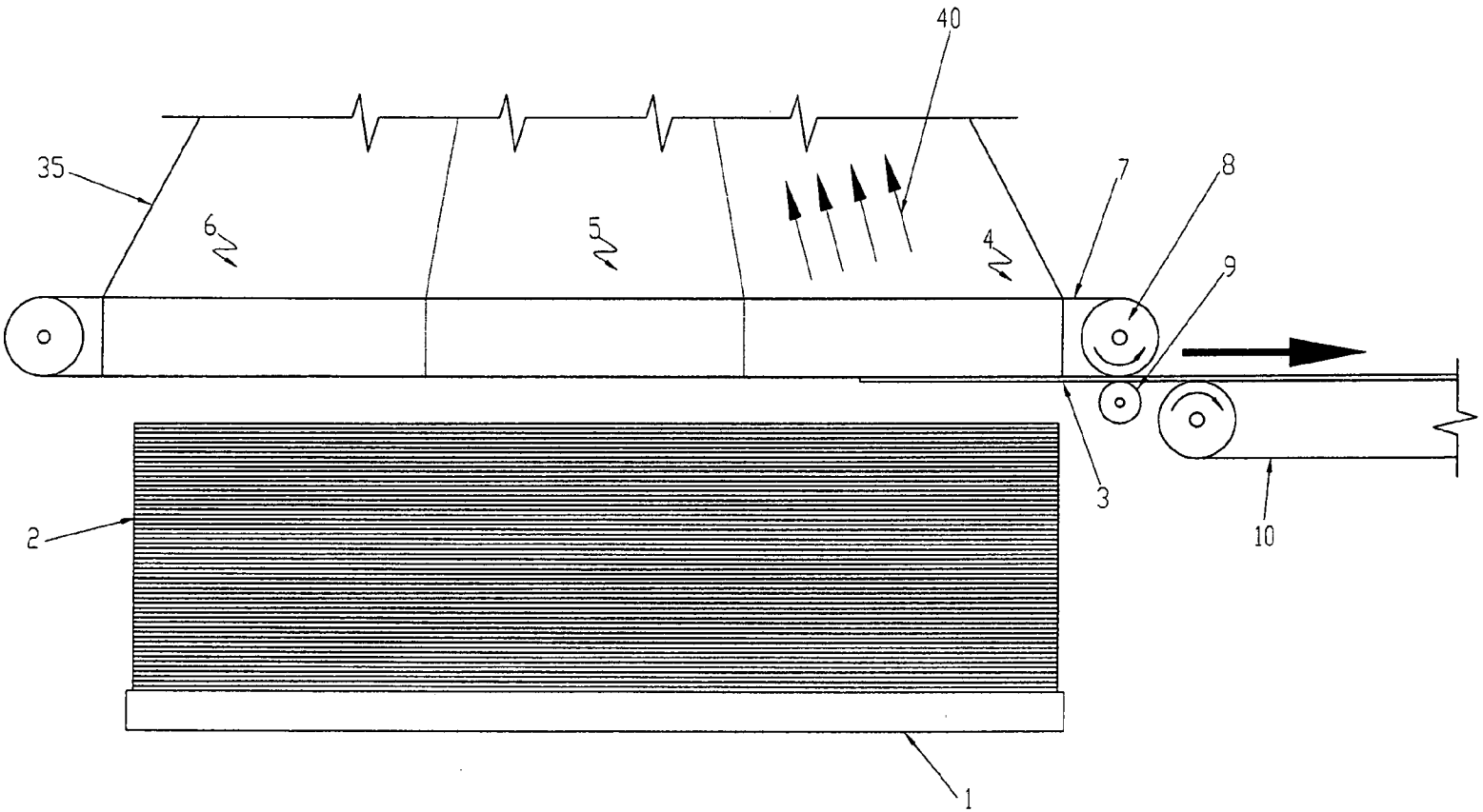
FIG. 2F is a schematic representation of the apparatus showing the deactivation of the middle intake chamber and the use of the pinch roller to provide additional power in pulling the top panel from the conveyor.

Once the top panel 3 is completely engaged to conveyor 7, conveyor 7 is activated to transport top panel 3 to a designated location. Referring to FIG. 2E, the front section of the top panel 3 is fed between a conveyor roller 8 and a pinch roller 9. The pinch roller 9 provides additional power to pull the top panel 3 from the conveyor 7. As the back section of the top panel 3 passes from underneath intake chamber 6, the suction force 42 produced from intake chamber 6 is deactivated. The front section of the top panel 3 may be fed onto an additional conveyor 10 for transporting to another location. FIG. 2F illustrates the continued transport of the top panel 3. As illustrated, the suction force 41 produced from intake chamber 5 is deactivated as the back section of the top panel 3 passes from underneath intake chamber 5. Last, FIG. 2G illustrates the deactivation of the suction force 40 produced by intake chamber 4 as the back section of the top panel 3 passes from underneath intake chamber 4. The method illustrated in FIGS. 2A–2G may be reversed by performing the steps in reverse order to form a stack of panels.

Viewing FIG. 2A, one embodiment of the present invention will utilize sensors in combination with a programmable controller 65 to control various functions of the apparatus. Upon detecting some type of change, the sensors signal the programmable controller 65. The programmable controller 65 then responds by activating or deactivating a designated function of the apparatus. Timers (not shown) may be used in combination with the sensors and programmable controller 65 to control delays in activating or deactivating certain designated apparatus functions.

FIG. 2A schematically illustrates a programmable controller 65 and several sensors 68–72. While not explicitly shown, it will be understood that wiring interconnects programmable controller 65 and the several sensors. A typical pre-handling configuration for moving panels to the apparatus of the invention is not shown, but is described as follows. A series of roller conveyors, positioned end to end, will lead to the lift bed 1 of the apparatus. To begin processing the panels, a stack of panels 2 is deposited on a first roller conveyor at a designated deposit site by a forklift, or other loading means. A first optical sensor, such as a laser, is located near the first roller conveyor, to detect the presence or absence of a stack of panels at the deposit site. A second optical sensor is positioned near a second roller conveyor for detecting the presence or absence of a stack of panels at an interim site. In operation, if the first optical sensor detects the presence of a stack of panels at the deposit site, and the second optical sensor detects the absence of a stack of panels at the interim site, the programmable controller triggers the first roller conveyor to transport the stack of panels to the interim site. As seen in FIG. 1A, a third optical sensor 68 is positioned near the lift bed 1 to detect the presence or absence of a stack of panels 2 on the lift bed 1. A fourth optical sensor 69 is located near the lift bed 1 to detect when the lift bed 1 is in its lowered receiving position. A stack of panels 2 positioned at the interim site will be transported onto the lift bed 1 if the third optical sensor 68 detects the absence of a stack of panels 2 on the lift bed 1, and the fourth optical sensor 69 detects the lift bed 1 in its receiving position. When the third optical sensor 68 detects the presence of a stack of panels on the lift bed 1, the programmable controller 65 is signaled to cease transporting the stack of panels 2.

Not only does the third optical sensor 68 signal when to stop transporting the stack of panels 2, the third optical sensor 68 also signals vertically raising the lift bed 1. A fifth optical sensor 70 and sixth optical sensor 71 detect the sufficient vertical elevation of the lift bed 1. The fifth optical 70 senor detects when the top panel 3 of a stack of panels 2 moves to within sufficient distance of the conveyor 7 and housing 35 to permit the lifting of a top panel b suction force. The sixth optical sensor 71, located above the fifth optical sensor 70, detects whether the lift bed 1 and stack of panels 2 have been raised too close to the conveyor 7 and housing 35. When the top panel triggers the fifth optical sensor 70, the fifth optical sensor 70 signals the programmable controller 65 to stop elevating the lift bed 1. If the lift bed 1 accidentally continues to be elevated, the sixth optical sensor 71 is triggered, thereby signaling the programmable controller 65 to lower lift bed 1 to within sufficient proximity of the conveyor 7 and housing 35.

At this point, the programmable controller 65 activates a first vacuum source (not shown) to peel the leading end of a top panel from the stack of panels by suction force. Prior to the top panel engaging the conveyor, plungers 24, under low air pressure, are slightly extended below the conveyor 7. The plungers 24 have mounted triggers to detect when the plungers 24 are pushed inward. When the suction force causes the leading end of the top panel 3 to engage the conveyor 7, the plungers 24 are pressed inward, signaling to the programmable controller 65 that the top panel 3 has engaged the conveyor 7. At this point, if the sixth optical sensor 71 does not detect the presence of a second panel attached to the top panel 3 (another function of the sixth optical sensor aside from detecting the elevation of the lift bed 1), the programmable controller 65 sends a response to the lift bed 1 to vertically lower, and the plungers 24 are signaled to entirely retract. However, if the sixth optical sensor 71 does detect the presence of one or more stuck panels, the plungers 24 are signaled to extend vertically downward on the upper surface of the top panel 3 causing separation of the stuck panels.

A timer programmed into the programmable controller 65 controls the activation of a second vacuum source (not shown). Once the plungers 24 are triggered inward, indicating a top panel is engaged with the conveyor 7, the programmable controller 65 activates a second vacuum source after a programmed lapse of time. Also, after a predetermined lapse of time from the inward triggering of the plungers 24, the conveyor 7 is activated to transport the engaged top panel 3 to another designated location. A seventh optical sensor 72 detects when the entire top panel 3 has been cleared from the conveyor 7, signaling the programmable controller 65 to shut off the vacuum sources and begin the process again. Of course, these are just illustrative examples and those skilled in the art will recognize many further functions that could be controlled by properly placed sensors. Additionally, programmable controller 65 could be any conventional processor running appropriate control software or be any conventional programmable logic array capable of controlling the various sensors. Likewise, it should be obvious that the apparatus could function through manual operation, as opposed to using sensors and programmable controllers to automate the functions of the apparatus.

The embodiment of the apparatus illustrated in FIG. 3 uses a combination of multiple vacuum sources 11*a*, 11*b*, multiple intake chambers 4, 5, 6 and an intake valve 15 to produce a sequence of suction forces. However, it should be obvious to those skilled in the art that changing the number and configuration of vacuum sources, intake chambers and intake valves can alter the sequence of suction forces. For instance, another way of creating a sequence of suction forces is to use one vacuum source connected to three or more intake chambers, with two of the three intake chambers having intake valves. Activating the vacuum source would create a suction force from the intake chamber lacking an intake valve. By sequentially opening the intake valves in the other two intake chambers, a sequence of suction forces would be accomplished.

Figure 6A:
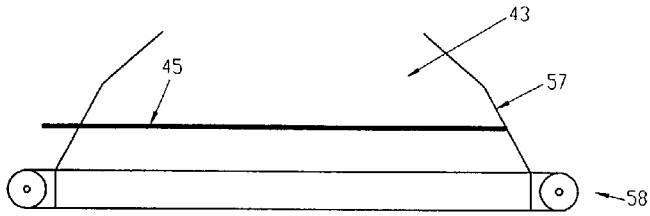
FIGS. 6A, 6B, 6C and 6D are schematic representations of an alternate configuration of the apparatus.
Figure 6B:
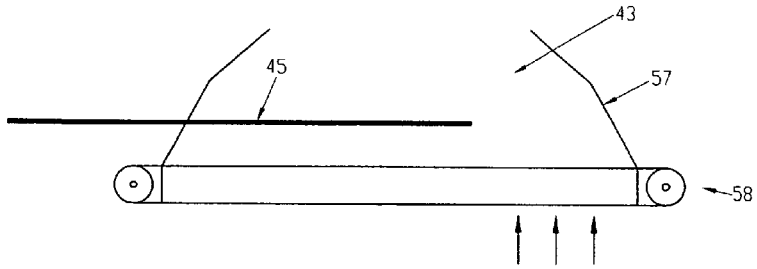
Figure 6C:
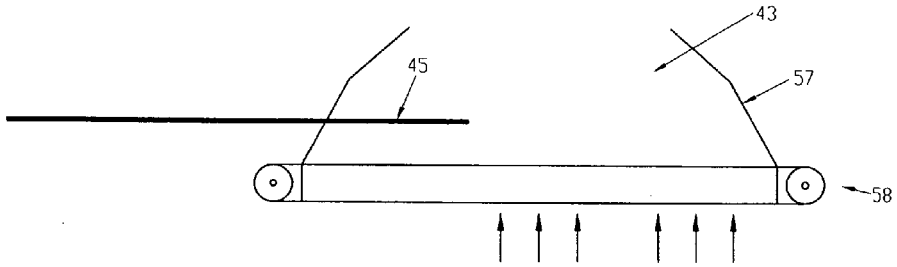
Figure 6D:
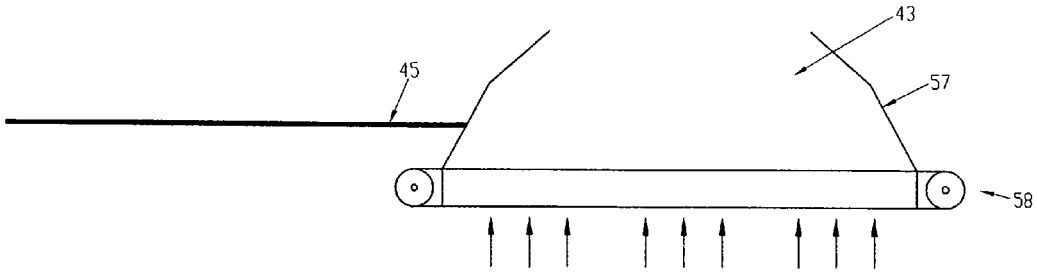

An alternate embodiment and method for creating a sequence of suction forces is illustrated in FIGS. 6A–6D. In FIG. 6A, a vacuum source (not shown) is positioned above housing 57 and conveyor 58. The vacuum source operatively connects to the housing 57, wherein housing 57 defines one large intake chamber 43. It should be emphasized that a housing 57, lacking any dividing walls, defines one intake chamber. Stated another way, a housing operatively connecting a vacuum source to at least one suction aperture, defines an intake chamber. The underside of housing 57 defines one large suction aperture 44, having a horizontal slide valve 45 which blocks all or a majority of the air intake between the large suction aperture 44 and vacuum source (not shown). The housing 57 and conveyor 58 are supported above a lift bed (not shown) by frame 59. The housing 57 and conveyor 58 are capable of canting at various angles in a manner as described above. As shown in FIG. 6B, activating the vacuum source produces a suction force from that portion of the large suction aperture 44 not blocked by the horizontal slide valve 45. Sequentially opening the horizontal slide valve 45, sequentially unblocks the air intake between large suction aperture 44 and the vacuum source, causing a sequence of suction forces to be exerted along the length of large suction aperture 44. As shown by FIG. 6C, the horizontal slide valve is opened to a position unblocking approximately two-thirds of the large suction aperture 44, thereby sequentially exerting suction forces along the length of the exposed two-thirds of large suction aperture 44. FIG. 6D illustrates further opening of the horizontal slide valve so that the air intake between the large suction aperture and the vacuum source is completely unblocked. This, in effect, produces a series of sequential suction forces.

Figure 7:
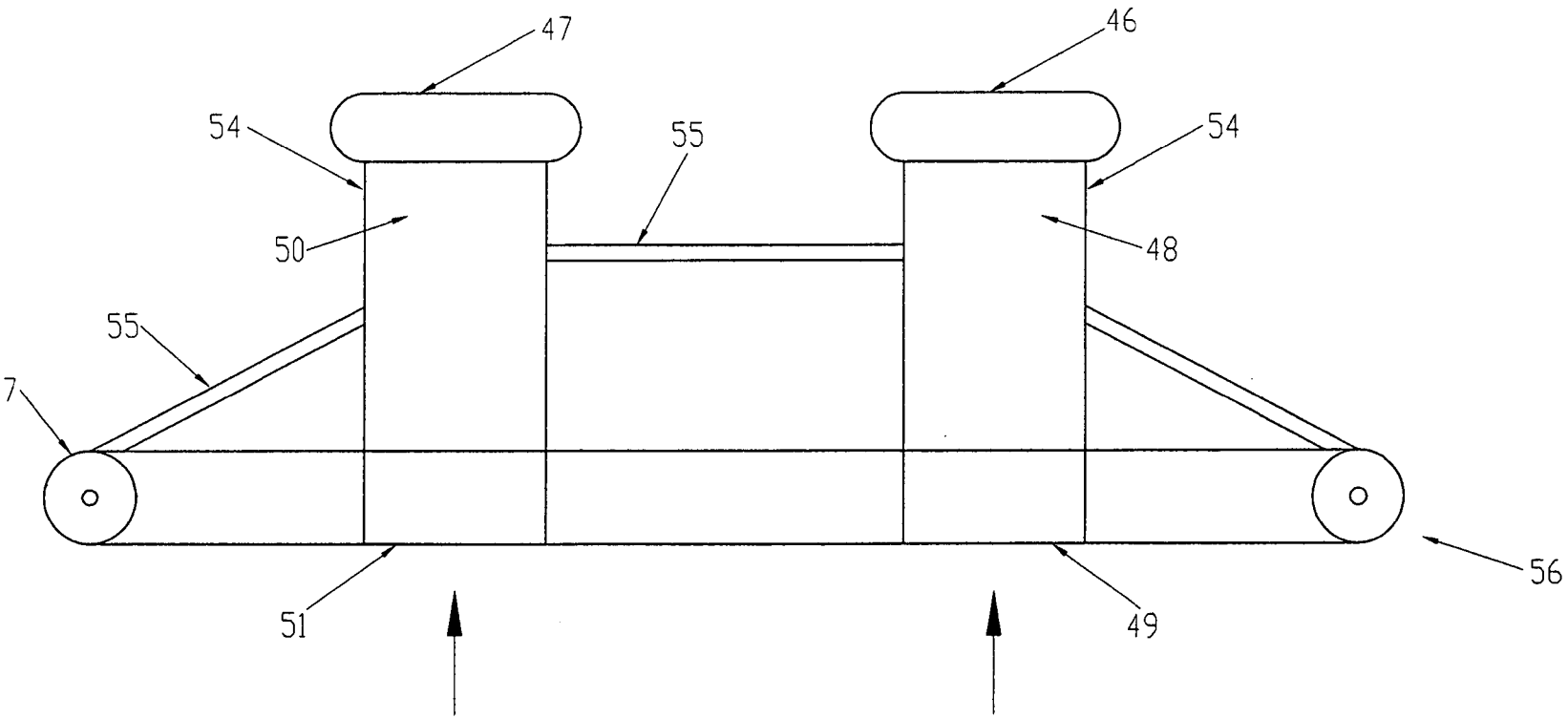
FIG. 7 is a schematic representation of a further alternate configuration of the apparatus.

FIG. 7 illustrates another alternate embodiment and method for creating a sequence of suction forces using the sequential operation of two vacuum sources 46, 47. Vacuum sources 46, 47 are positioned above housing 54 and conveyor 56. Although two separate structures are shown as housing 54, as explained above, a housing includes any number of structures capable of producing a sequence of suction forces. Vacuum source 46 is operatively connected to housing 54, wherein housing 54 defines an intake chamber 48, and a suction aperture 49. Vacuum source 47 is operatively connected to housing 54, wherein housing 54 defines an intake chamber 50 and a suction aperture 51. Housing 54 and conveyor 56 are supported above a lift bed (not shown) by frame 55. By first activating vacuum source 46, a first suction force is exerted at suction aperture 49. By next activating vacuum source 47, a second suction force is exerted at suction aperture 51. The combination of the first suction force and the second suction force creates a sequence of suction forces. It should be obvious to those skilled in the art that any number of vacuum sources and intake chambers could be added to create additional sequential suction forces.

What is claimed is:

1. An apparatus for lifting, separating and transporting a top panel from a stack of panels, comprising:

a. a housing having an underside with a conveyor positioned adjacent thereto, said conveyor allowing a suction force therethrough, b. a vacuum source connected to said housing and applying a suction force across said conveyor, c. said housing further comprising at least two intake chambers and defining at least one suction aperture above said conveyer, wherein each of said intake chambers operatively connects at least one said suction aperture to said vacuum source thereby defining an intake passage for the flow of air between said vacuum source and said suction aperture, d. said intake chambers further comprising an intake valve operatively connected to said housing, and positioned between said vacuum source and said suction aperture, wherein the opening and shutting of said intake valve creates a sequential application of said suction force from said suction aperture along a length of said conveyor, e. a lift bed for supporting a stack of panels, whereby said lift bed is positioned below said conveyor and said housing, and is capable of being positioned within sufficient proximity to said suction aperture so that said sequential suction force lifts a top panel from a stack of panels, and f. a frame for supporting said housing and said conveyor above said lift bed.

2. An apparatus as defined in claim 1, wherein said housing and said conveyor are capable of canting about at least one pivot point.

3. An apparatus as defined in claim 2, wherein said conveyor includes at least two belts sufficiently spaced apart to allow the passage of air between said belts.

4. An apparatus as defined in claim 3, further comprising at least two vacuum sources.

5. An apparatus as defined in claim 4, further comprising at least one pinch roller positioned adjacent to a belt roller and defining a receiving space between said pinch roller and said belt roller.

6. An apparatus as defined in claim 5, further comprising at least one plunger retractably mounted to said housing, said plunger capable of separating said top panel from an adjacent stuck panel.

7. An apparatus as defined in claim 6, further comprising at least one slide gate operatively connected to said housing.

8. An apparatus as defined in claim 7, wherein said vacuum source includes a dampening shutter operatively connected to a breather.

9. An apparatus as defined in claim 8, further comprising a programmable controller and sensors for automating designated functions of said apparatus.

10. An apparatus for lifting, separating and transporting a top panel from a stack of panels, comprising:

a. housing means for forming at least one suction aperture, b. conveying means for allowing the passage of air therethrough and for engaging a top panel, said conveying means operatively connected to said housing means, c. vacuum means for evacuating air from said suction aperture, d. sequential suction means for creating a sequence of suction forces on an upper surface of a top panel from a stack of panels causing said top panel to peel away from said stack of panels, e. support means for supporting a stack of panels, f. frame means for supporting said housing means and said conveying means above said stack of panels, g. Vertical movement means for causing the relative distance between said support means and said conveying means to become sufficient for lifting a top panel from a stack of panels by the application of a sequence of suction forces.

11. A method of lifting, separating and transporting a top panel from a stack of panels, comprising the steps of:

a. positioning a stack of panels beneath a vacuum conveyor having an underside defining at least one suction aperture, wherein said vacuum conveyor is capable of applying a sequential suction force from said suction aperture along a length of said vacuum conveyor, b. vertically elevating a stack of panels so that the upper surface of said top panel is in sufficient proximity to said vacuum conveyor to permit suction forces to lift said top panel into engagement with said vacuum conveyor, c. applying a first suction force to an upper front surface of said top panel causing a front section of said top panel to engage said vacuum conveying means, and subsequently applying a second suction force to an upper back surface of said top panel causing a back section of said top panel to engage said vacuum conveying means, said panel being separated from said stack of panels, and d. transporting said top panel along said conveyor to a designated location.

12. A method as in claim 11 further including the step of applying a suction force after the application of said first suction force and before the application of said second suction force, to an upper middle surface of said top panel causing a middle section of said top panel to engage said vacuum conveying means.

13. A method as in claim 11 or 12, wherein the steps are reversed so that a top panel may be deposited onto a stack of panels.

14. An apparatus for lifting, separating and transporting a top panel from a stack of panels, comprising a. a housing having an underside with a conveyor positioned adjacent thereto, said conveyor allowing a suction force therethrough, b. a vacuum source connected to said housing and applying a suction force across said conveyor, c. said housing defining at least one suction aperture above said conveyer, d. at least one slide gate operatively connected to said housing between said vacuum source and said suction aperture, wherein said the movement of said slide gate creates a sequential suction force to be applied from said suction aperture along a length of said conveyor, e. a lift bed for supporting a stack of panels, whereby said lift bed is positioned below said conveyor and said housing, and is capable of being positioned within sufficient proximity to said suction aperture so that said sequential suction force lifts a top panel from a stack of panels, and f. a frame for supporting said housing and said conveyor above said lift bed.

15. An apparatus for lifting, separating and transporting a top panel from a stack of panels, comprising a. a housing having an underside with a conveyor positioned adjacent thereto, said housing defining at least one suction aperture above said conveyor and said conveyor allowing a suction force therethrough, b. at least two vacuum source connected to said housing and applying a suction force across said conveyor, wherein said vacuum sources can be activated in sequence to create a sequential suction force from said suction aperture along a length of said conveyor, c. a lift bed for supporting a stack of panels, whereby said lift bed is positioned below said conveyor and said housing, and is capable of being positioned within sufficient proximity to said suction aperture so that said sequential suction force lifts a top panel from a stack of panels, and d. a frame for supporting said housing and said conveyor above said lift bed.

16. An apparatus as defined in claim 15, wherein said conveyor includes at least two belts sufficiently spaced to allow the passage of air between said belts.

17. An apparatus as defined in claim 16, wherein each of said belts define at least one area of suction passage therethrough.

18. An apparatus as defined in claim 15, further comprising a programmable controller and sensor for automating designated functions of said apparatus.

19. An apparatus as defined in claim 15, wherein said housing and said conveyor are capable of canting about at least one pivot point s.

* * * * *